US010280540B2

(12) United States Patent
Aquino

(10) Patent No.: US 10,280,540 B2
(45) Date of Patent: May 7, 2019

(54) QUILT BLOCK EASEL

(71) Applicant: SA Richards, Inc., Fort Lee, NJ (US)

(72) Inventor: Richard Aquino, Fort Lee, NJ (US)

(73) Assignee: SA Richards, Inc., Fort Lee, NJ (US)

( * ) Notice: Subject to any disclaimer, the term of this patent is extended or adjusted under 35 U.S.C. 154(b) by 252 days.

(21) Appl. No.: 15/465,501

(22) Filed: Mar. 21, 2017

(65) Prior Publication Data

US 2018/0274146 A1 Sep. 27, 2018

(51) Int. Cl.
*D05B 39/00* (2006.01)
*A47B 97/08* (2006.01)
*D06C 3/00* (2006.01)

(52) U.S. Cl.
CPC ..... *D05B 39/005* (2013.01); *A47B 97/08* (2013.01); *D06C 3/00* (2013.01)

(58) Field of Classification Search
CPC ..... D05B 39/005; D06C 3/00; A47B 97/08
See application file for complete search history.

(56) References Cited

U.S. PATENT DOCUMENTS 2,318,877 A * 5/1943 Meyer ..... D05B 39/005 38/102.6
2,474,659 A * 6/1949 Ebert ..... A47G 1/141 248/459
2,880,948 A * 4/1959 Nichols ..... G09F 1/00 248/465
5,351,425 A * 10/1994 Knappe ..... G09F 1/14 40/751
5,733,166 A * 3/1998 Hoag ..... A63H 3/00 40/735
2002/0104244 A1* 8/2002 Moss ..... G09F 1/06 40/610
2005/0279906 A1* 12/2005 Moss ..... A47B 97/08 248/459
2018/0049549 A1* 2/2018 Conrad ..... A47B 97/08

* cited by examiner

*Primary Examiner* — Tajash D Patel
(74) *Attorney, Agent, or Firm* — Kaplan Breyer Schwarz, LLP

(57) ABSTRACT

An easel for use in the quilting art is provided. The easel has a design board has a front, working surface upon which a person who is creating a quilt may compose a quilt block from individual pieces of fabric. Either extending from, or attached to a back surface of the design board, the easel has a selectively collapsible, support assembly. Two selectively pivotable legs and a rib of the support assembly allow the easel to be stored or transported in a substantially flat condition and/or erected into a substantially standing position when in use. A woven, preferably, microfiber fabric sized to fit around and cover the front, working surface of the design board, is also provided. The fabric being selectively removable and able to be laundered. A storage case is included.

12 Claims, 7 Drawing Sheets

QUILT BLOCK EASEL

TECHNICAL FIELD

This disclosure relates to the field of quilting, and more particularly, to an easel to be used by a person in creating and arranging quilt blocks.

BACKGROUND

Quilting is a very exacting and complex craft specialty involving not only complicated creative and design decisions, but also skill with assorted tools for cutting, measuring, preparing and sewing the component pieces together. One category of tools consists of so-called "design walls" and "design boards". They essentially differ from each other with respect to size. Design boards range from 10" to 18" square and design walls can be larger, extending up to approximately 72" square. Both are typically made of foam board and covered with batting, flannel, or fleece fabric.

Design walls and boards in general help the quilter preview the component units that comprise a quilt—before these components are sewn together. The first level of unit, are "quilt blocks" which are composed of a number of individual fabric pieces. Next is a series or combination of quilt blocks which in turn compose a completed quilt. Using a design wall, the quilter can experiment with the series quilt blocks that comprise a major portion of or indeed the entire quilt. Design boards on the other hand usually display only one completed quilt block. Being of manageable size, design boards, displaying one completed but yet-to-be-sewn block, can be conveniently placed on the sewing table and viewed by the quilter. Piece-by-piece the component units of the quilt block are removed from the board and sewn together in proper sequence. Quilt blocks in turn are typically 12" to 18" square. Some blocks are simple, others are complex, but whichever it may be, it is always desirable for the quilter to have a platform upon which to layout and visualize the pieces.

Unfortunately, however, design walls are usually just that; i.e., a large wall and suited to rest on the floor rather than on a table. Design bards are for tabletop use but are typically designed to lay flat with no device to prop them up. Accordingly, it would be desirable for there to be a tabletop design that displays the quilt block upright, a configuration that is both easier to view and requires significantly less tabletop space.

SUMMARY

The subject easel assembly is constructed to hold one quilt block during both the design/layout phase where the fabric pieces are being combined in various proposed ways to create the overall quilt, and then once this phase is complete and the block is ready for sewing, it can be carried on the subject assembly, without fear of pieces falling off, from the cutting table to the sewing table for final assembly.

The upright, easel construction of the subject assembly overcomes the deficiencies of existing design boards. The subject assembly, a) takes up less of the scarce work/tabletop space since it stands substantially vertically instead of laying horizontally on the worktable, b) provides the ideal viewing angle thereby reducing neck and back strain during extended sessions, c) folds substantially flat for storage or transporting the easel, d) uses a woven, preferably, but not necessarily, microfiber, fabric, e) the fabric is selectively removable, allowing it to be laundered, and f) the woven fabric is superior to the normally used fleece fabrics, non-woven flannels or batting material of design boards.

Design boards that use fleece fabric, non-woven flannel or batting are inferior to the subject woven fabric in two ways: First, in terms of grabbing and holding the fabric pieces. And, if a woven, microfiber fabric is used, because such fabrics are engineered to attract dirt and dust, and to hold on to them, use of such a microfiber fabric even further enhances the ability of the subject assembly to grab and hold onto the fabric pieces. Second, in terms of physical integrity. Because they are not woven, batting and fleece, in particular, can easily tear and wear away over time, losing the limited holding capacity they have.

Existing design boards and walls have fabric surfaces that are permanently attached to them. Even if they could be removed, batting and flannel cannot be laundered without diminishing their capacity to hold quilt fabric pieces. In contrast, either the woven fabric, or woven microfiber fabric, of the subject assembly can be laundered, and it can be easily removed from the board since it is attached to it by use of an elastic band, or multiple elastic bands, sewn around its periphery. Further, once attached over the working surface of the design board, the woven fabric maintains a tight fit owing to the elastic band(s), and, in a preferred embodiment, to the use of hook fabric disks; i.e., the "hook" side of hook-and-loop fabric, installed around the edges of the back of the board that hook onto the fabric of the woven fabric to help hold the fabric in place.

BRIEF DESCRIPTION OF THE DRAWINGS

For the purposes of illustrating the various aspects of the invention, wherein like numerals indicate like elements, there are shown in the drawings simplified forms that may be employed, it being understood, however, that the invention is not limited by or to the precise arrangements and instrumentalities shown. To assist those of ordinary skill in the relevant art in making and using the subject matter hereof, reference is made to the appended drawings and figures, wherein.

DETAILED DESCRIPTION OF THE PREFERRED EMBODIMENTS

Figure 4:
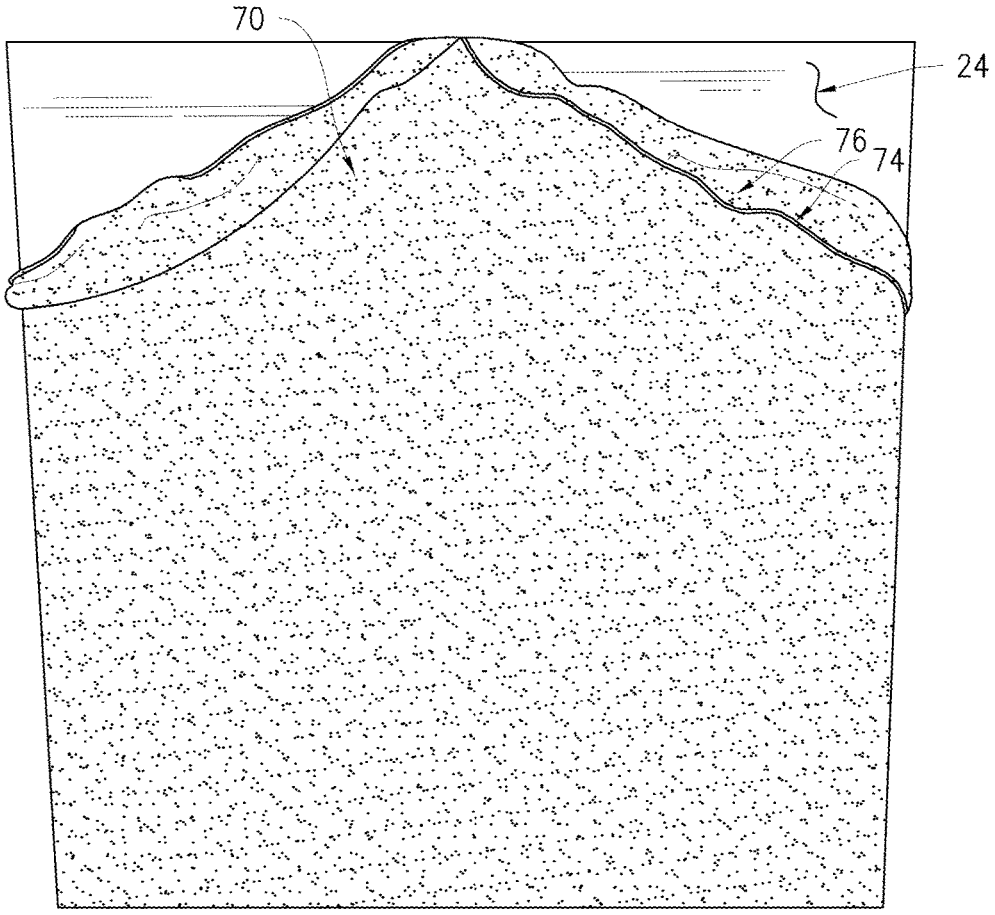
FIG. 4 is a front elevational view of the structure of FIG. 1.

Referring to the figures, an easel used in preparing and organizing quilt blocks is generally designated at 10. Easel 10 is preferably comprised of a design board 20, having a back surface 22 and a front, working surface 24 (see FIG. 4). Extending from back surface 22 is a selectively collapsible, support assembly 30. Support assembly 30 has a first panel 32 and a second panel 34, a selectively collapsible rib element 36 located substantially between first and second panels 32 and 34, and selectively collapsible left 40 and right 42 leg elements. Rib 36 is selectively pivotable along a scored edge 38, connecting it with second panel 34. Left leg 40 is selectively pivotable along scored edges 44 and 46. Scored edge 44 connects a portion of left leg 40 to first panel 32 and scored edge 46 connects another portion of left leg 40 to second panel 34. Right leg 42 is selectively pivotable along scored edges 54 and 56. Scored edge 54 connects a portion of right leg 42 to first panel 32 and scored edge 56 connects another portion of right leg 42 to second panel 34.

Figure 1:
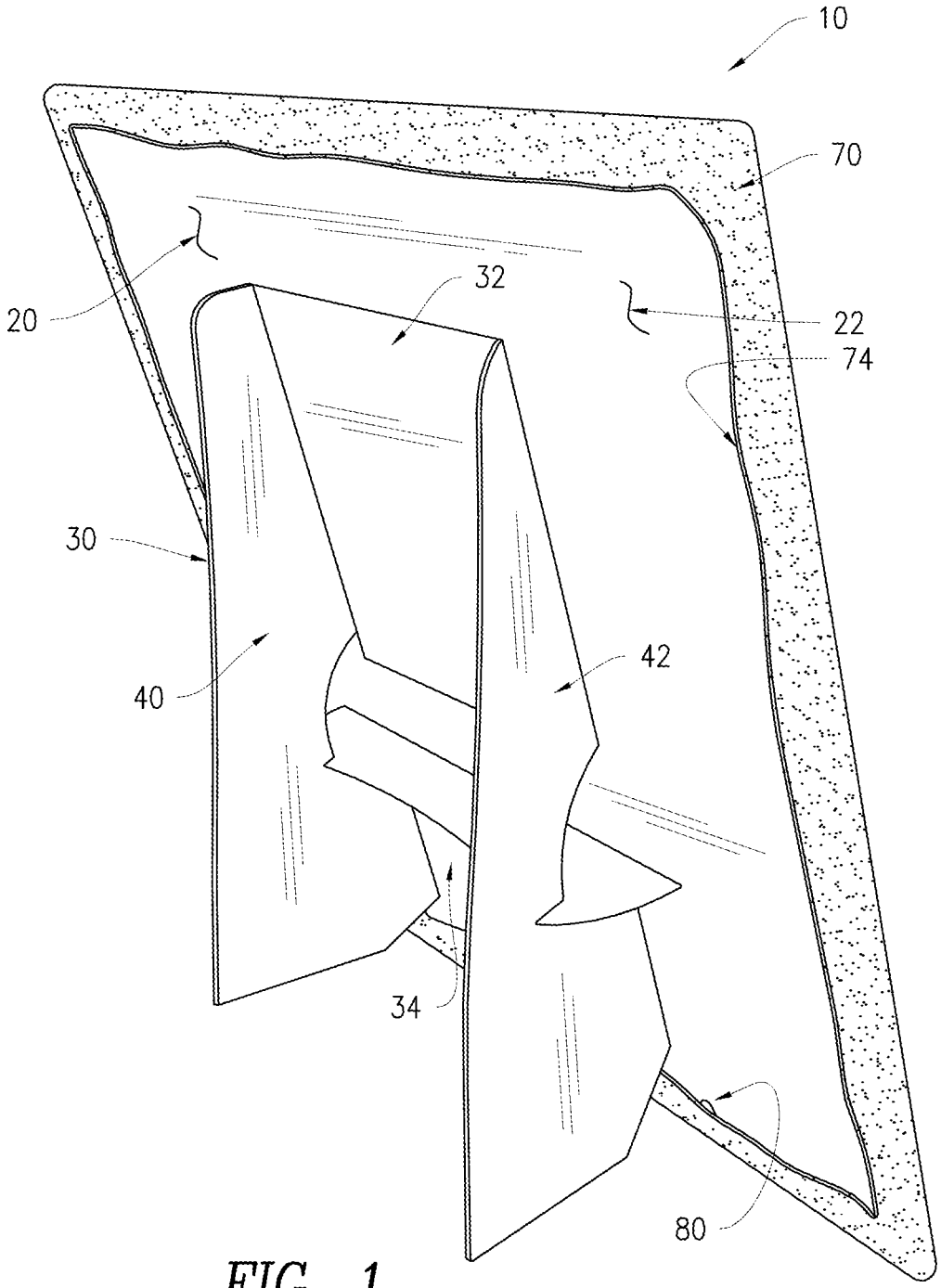
FIG. 1 is a back perspective view of a quilt block easel made in accordance with at least one embodiment of the present invention.
Figure 2:
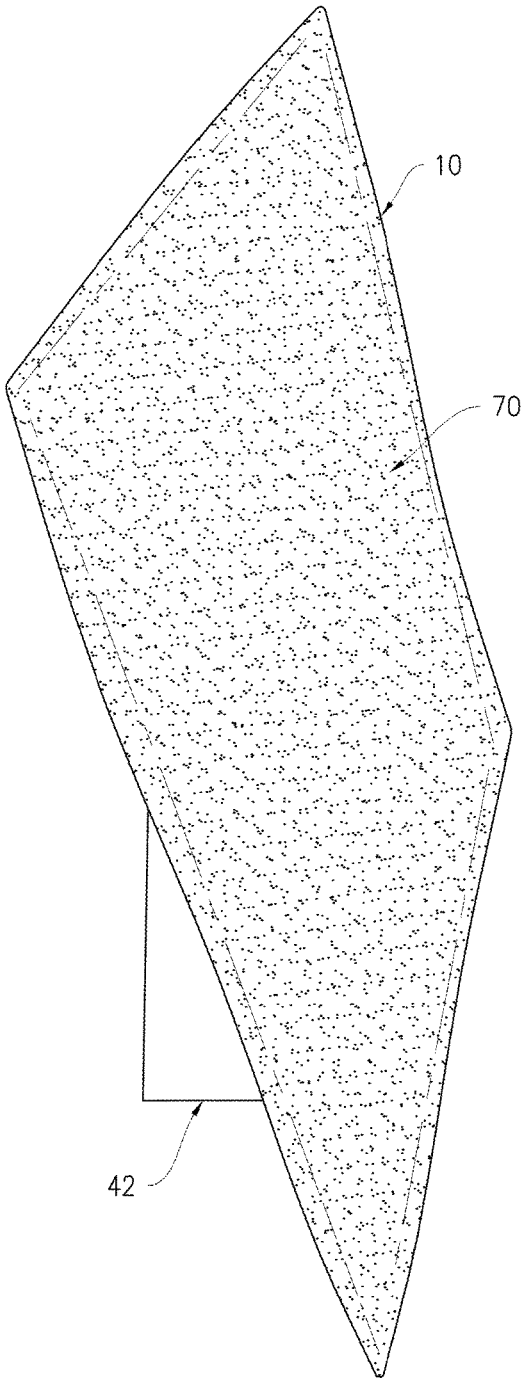
FIG. 2 is a front perspective view of the structure of FIG. 1.
Figure 3:
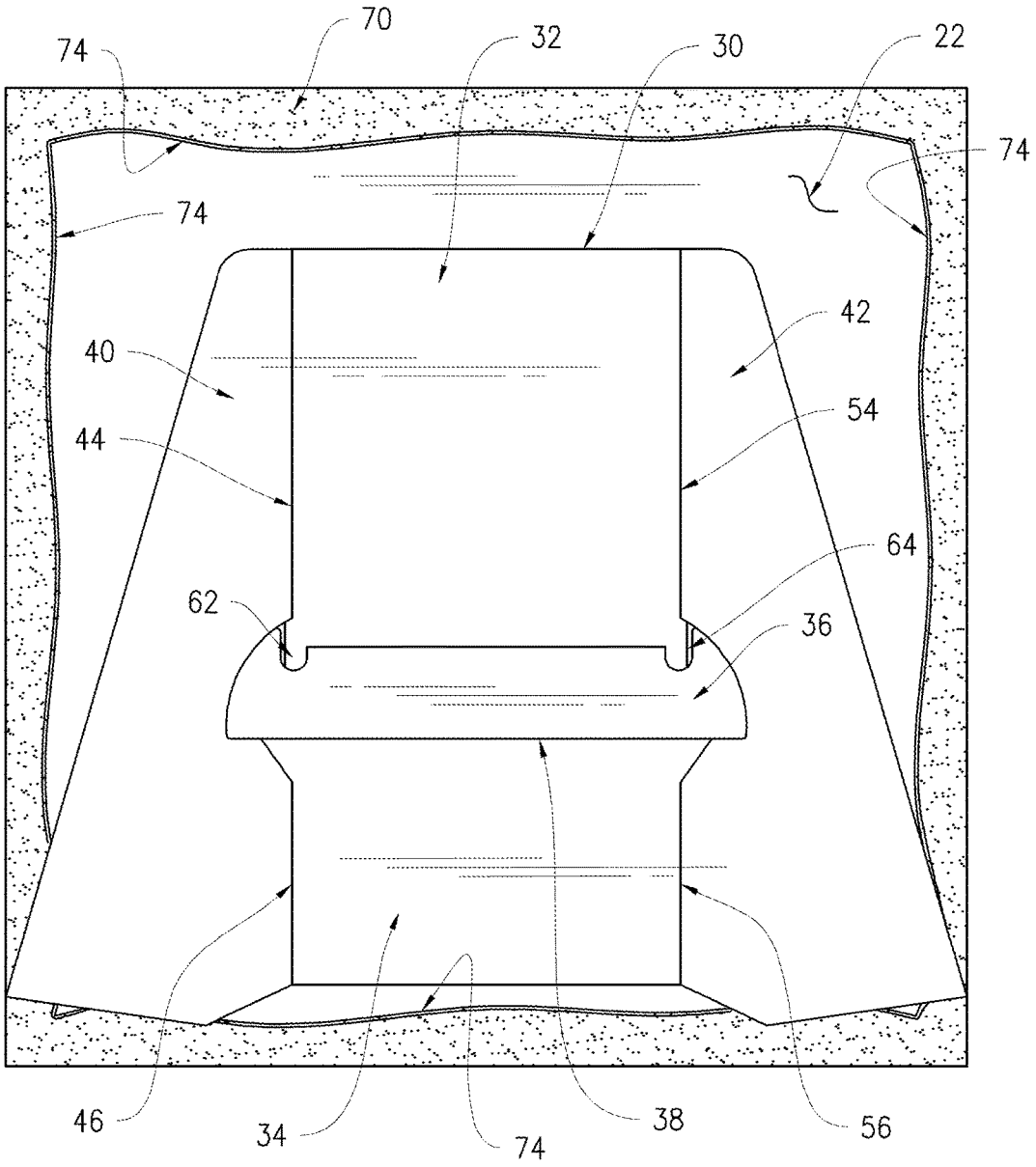
FIG. 3 is a back elevational view of the structure of FIG. 1.
Figure 7:
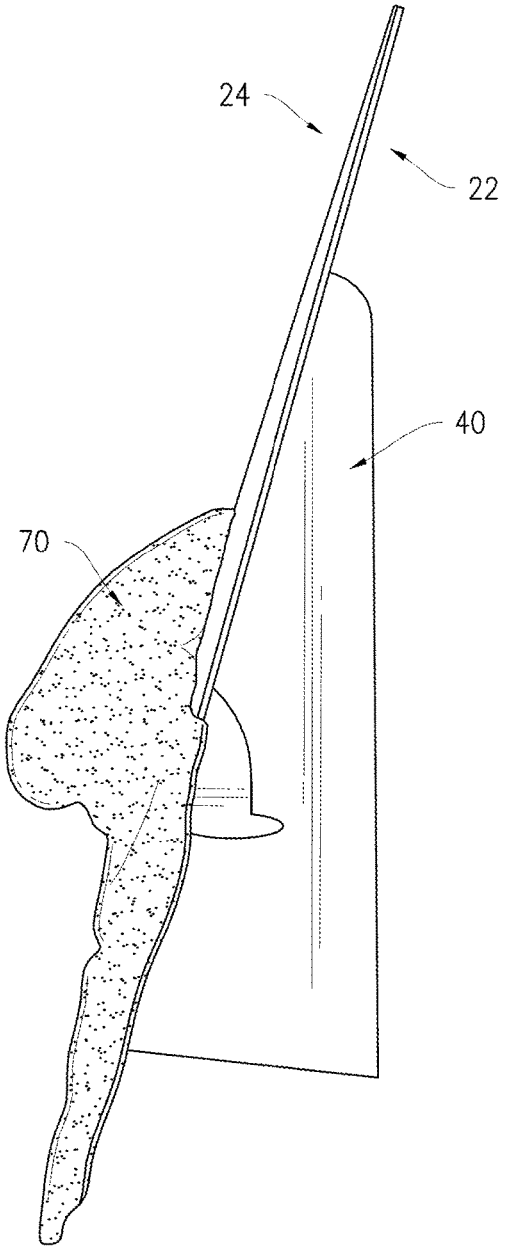
FIG. 7 is a side elevational view of the structure of FIG. 1.

Support assembly 30 is in a first, nonsupport configuration when rib 36 and left and right legs 40 and 42, respectively, are collapsed in substantially flat orientations against back surface 22 of design board 20. Support assembly 30 is in a second, support configuration when rib 36 is pivoted about edge 38 to extend away from back surface 22 of design board 20. In such a pivoted and extending away position, portions 62 and 64 of rib 36 engage with portions of left leg 40 and right leg 42 in such a way as to hold both legs in pivoted positions also extending away from back surface 22. In this pivoted position, support assembly 30 is in the second, support configuration shown best in FIGS. 1, 5 and 7.

Easel 10 also has a fabric 70 sized to fit around and cover front, working surface 24 of design board 20. Fabric 70 is preferably a woven fabric, and in an even further preferred embodiment fabric 70 is a microfiber fabric. In a preferred embodiment, in order to fit around and cover front, working surface 24, fabric 70 comprises a woven fabric sheet 72 that has a larger area than an area of front, working surface 24. In order to hold fabric 70 onto design board 20, fabric sheet 72 has a peripheral edge 74, and, in a preferred embodiment, along the entire periphery edge 74 is found one continuous elastic band 76, wherein the fabric sheet is selectively, removably secured over the front, working surface of the design board by the elastic band attached along the periphery. It is noted, however, that instead of on continuous elastic band 76, smaller lengths along periphery edge 74 can have a plurality of elastic bands. Such alternate construction, not shown, could be at the "corners" of fabric sheet 72.

Figure 5:
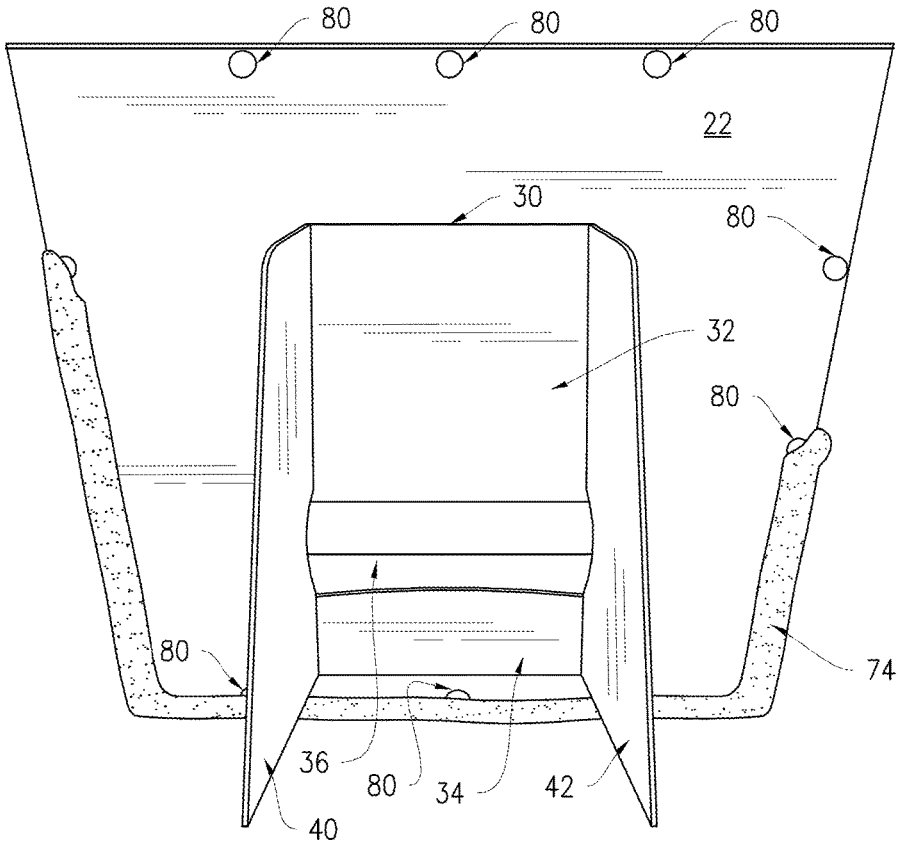
FIG. 5 is a back perspective view of the structure of FIG. 1.
Figure 6:
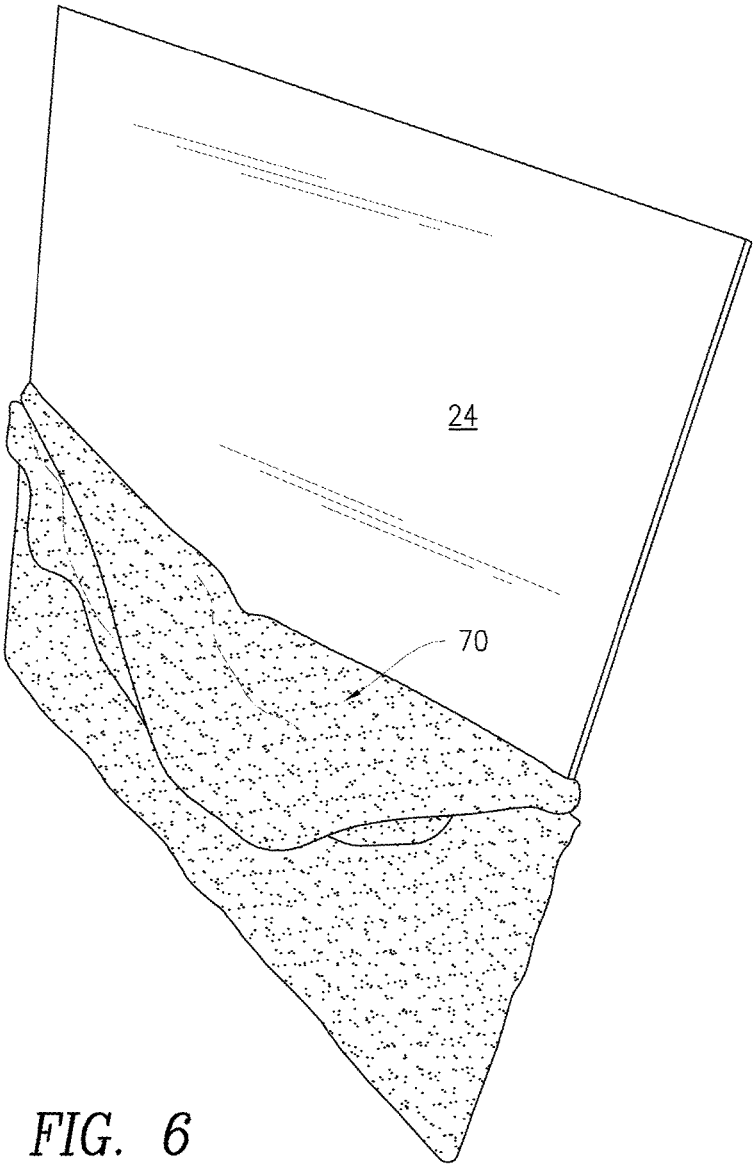
FIG. 6 is a front perspective view of the structure of FIG. 1.

As best seen on FIG. 5, fabric sheet 72 is further selectively, removably secured over front, working surface 24 of design board 20 by a plurality of hook fasteners 80 that attach to fabric loops of fabric 70 (not shown) when edge 74 is secured over front, working surface 24.

In various other preferred embodiments, design board 20 and support assembly 30 may be unitarily formed, or support assembly 30 may be adhered to back surface 22 of design board 20, or metal fasteners, such as, but not limited to, grommets (not shown), may be used to attached support assembly 30 to back surface 22 of design board 20. In any of these embodiments, it is also allowed that the material of which design board 20 and support assembly 30 are made are the same material or different materials, and the material(s) are of any of those known in the art; as, for example, plastic, wood, cardboard, pressboard, or any other.

The subject assembly also anticipates a carry case able to fit the assembly therein when it is in its collapsed orientation. Such a case being useful in transporting or storing the assembly.

In another embodiment, not shown, design board 20 is larger and made with a score line to allow it to be folded-back against itself and then placed in the carrying case. In such an embodiment, either the board folds along a score-line and/or there are hinge-type structures located in such positions as to allow for collapsibility and erection of the board for storage/transport and for use of the fully extended board.

It will thus be seen that the objects set forth above, among those made apparent from the preceding description, are efficiently attained, and, since certain changes may be made in the above constructions without departing from the spirit and scope of the invention, it is intended that all matter contained in the above description and shown in the accompanying drawings shall only be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An easel for use in the quilting art, comprising:

a design board, comprising a front, working surface upon which a person who is creating a quilt may compose a quilt block from individual pieces of fabric, and a substantially opposite facing back surface;

a selectively collapsible, support assembly, comprising first and second panels extending from the back surface of the design board, a selectively collapsible rib element located substantially between the first and second panels and pivotably connected to the second panel along a common edge thereof, said rib element comprising spaced apart notches along an edge thereof opposite the common edge, and selectively collapsible left and right leg elements located substantially along left and right edges, respectively, of the first and second panels, wherein the support assembly is in a first, nonsupport configuration when the rib and left and right legs are in collapsed, substantially flat orientations against the back surface of the design board, and the support assembly is in a second, support configuration when the rib is pivoted about the common edge to extend away from the back surface of the design board and in such position the notches of the rib element engage the left and right legs to hold them in pivoted positions also extending away from the back surface of the design board; and a woven fabric sized to fit around and cover the front, working surface of the design board, comprising a woven fabric sheet larger in area than an area of the front, working surface of the design board, the fabric sheet having a periphery, and one continuous elastic band attached along the entire periphery of the fabric sheet, wherein the fabric sheet is selectively, removably secured over the front, working surface of the design board by the elastic band.

2. The easel of claim 1, further comprising a storage case for storing the easel in or transporting the easel when the easel is not in use.

3. The easel of claim 1, wherein the fabric sheet is further selectively, removably secured over the front, working surface of the design board by a plurality of hook fasteners that attach to fabric loops of the woven fabric when the periphery of the fabric sheet is secured over the front, working surface.

4. The easel of claim 1, wherein the support assembly is attached to the back surface of the design board.

5. The easel of claim 4, wherein the support assembly is adhered along surfaces of the first and second panels to the back surface of the design board.

6. The easel of claim 4, wherein the support assembly is attached to the back surface of the design board by metal fasteners.

7. The easel of claim 6, wherein the metal fasteners are grommets.

8. The easel of claim 1, the support assembly being unitarily formed of a single piece of material, the edge of the rib comprising a score-line allowing it to pivot and each edge of the first and second legs comprising a score-line allowing each leg to pivot.

9. The easel of claim 1, the design board and support assembly formed of the same material.

10. The easel of claim 1, the design board being of a larger size and comprising a score-line allowing for the design board to be folded.

11. The easel of claim 10, the design board being foldable along a score-line.

12. The easel of claim 10, having at least one hinge-type mechanism to allow the design board to be foldable and to assist it in maintaining its front, working surface in a substantially uniform flat condition when the larger size design board is in an unfolded state for use.

* * * * *